US010293204B2

(12) United States Patent
Astilean et al.

(10) Patent No.: US 10,293,204 B2
(45) **Date of Patent: *May 21, 2019**

(54) LEG-POWERED TREADMILL

(71) Applicant: Alex Astilean, East Hampton, NY (US)

(72) Inventors: Alex Astilean, East Hampton, NY (US); Dan Bostan, Beaconsfield (CA)

(73) Assignee: Speedfit LLC, East Hampton, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/918,384

(22) Filed: Mar. 12, 2018

(65) Prior Publication Data

US 2018/0214735 A1 Aug. 2, 2018

Related U.S. Application Data

(63) Continuation of application No. 15/186,826, filed on Jun. 20, 2016, now Pat. No. 9,914,015, which is a continuation of application No. 14/086,733, filed on Nov. 21, 2013, now Pat. No. 9,468,796, which is a continuation of application No. 13/711,074, filed on Dec. 11, 2012, now Pat. No. 8,690,738, which is a continuation of application No. 12/925,892, filed on Nov. 1, 2010, now Pat. No. 8,343,016, which is a continuation-in-part of application No. 12/925,770, filed on Oct. 29, 2010, now Pat. No. 8,308,619.

(60) Provisional application No. 61/280,265, filed on Nov. 2, 2009.

(51) Int. Cl.

| | |
|---|---|
| ***A63B 23/00*** | (2006.01) |
| ***A63B 22/02*** | (2006.01) |
| ***A63B 21/00*** | (2006.01) |
| ***A63B 22/00*** | (2006.01) |
| ***A63B 23/04*** | (2006.01) |

(52) U.S. Cl.

CPC ..... *A63B 22/02* (2013.01); *A63B 21/156* (2013.01); *A63B 22/0046* (2013.01); *A63B 22/0207* (2015.10); *A63B 22/0221* (2015.10); *A63B 22/0228* (2015.10); *A63B 22/0235* (2013.01); *A63B 23/0405* (2013.01)

(58) Field of Classification Search

None

See application file for complete search history.

(56) References Cited

U.S. PATENT DOCUMENTS

| | | | | |
|---|---|---|---|---|
| 1,211,765 A * | 1/1917 | Schmidt | A63B 22/02 482/54 |
| 3,024,891 A * | 3/1962 | Sawrie | B65G 17/123 198/799 |
| 3,075,764 A * | 1/1963 | De Lorean | A63G 11/00 472/106 |
| 3,403,880 A * | 10/1968 | Rude | A63B 5/10 248/346.03 |

(Continued)

*Primary Examiner* — Stephen R Crow

(74) *Attorney, Agent, or Firm* — Alfred M. Walker

(57) ABSTRACT

A motor-less leg-powered curved treadmill produced that allows people to walk, jog, run, and sprint without making any adjustments to the treadmill other than shifting the user's center of gravity forward and backwards. A closed loop treadmill belt running between front and rear pulley rollers is formed with a low friction running surface of transverse wooden, plastic or rubber slats attached to each other in a resilient fashion, wherein each transverse slat has at least one continuous fin descending downward therefrom.

10 Claims, 12 Drawing Sheets

(56) References Cited

U.S. PATENT DOCUMENTS 3,642,279 A * 2/1972 Cutter ..... A63B 22/02 482/54
4,343,016 A * 8/1982 Goldkuhle ..... G06K 9/033 348/32
4,361,115 A * 11/1982 Pike ..... A01K 15/027 119/700
4,938,473 A * 7/1990 Lee ..... A63B 22/02 482/27
4,974,831 A * 12/1990 Dunham ..... A63B 22/0023 482/54
5,382,207 A * 1/1995 Skowronski ..... A63B 22/0023 198/807
5,385,520 A * 1/1995 Lepine ..... A63B 22/0023 482/51
5,441,468 A * 8/1995 Deckers ..... A63B 22/02 198/841
6,042,514 A * 3/2000 Abelbeck ..... A63B 22/02 198/439
8,118,888 B2 * 2/2012 Molter ..... A63B 22/02 48/54
8,308,619 B1 * 11/2012 Astilean ..... A63B 21/156 482/54
8,690,738 B1 * 4/2014 Astilian ..... A63B 21/156 482/54
8,864,627 B2 * 10/2014 Bayerlein ..... A63B 21/0053 482/2
8,920,347 B2 * 12/2014 Bayerlein ..... A63B 22/0235 601/35
8,986,169 B2 * 3/2015 Bayerlein ..... A63B 21/0053 482/54
9,005,085 B2 * 4/2015 Astilean ..... A63B 22/02 482/54
9,694,234 B2 * 7/2017 Dalebout ..... A63B 22/02
9,764,178 B1 * 9/2017 Wein ..... A63B 21/0055
9,901,767 B2 * 2/2018 Kuo ..... A63B 21/0053
2006/0182576 A1 * 8/2006 Foster ..... B65G 25/065 414/525.1
2007/0155592 A1 * 7/2007 Hoag ..... A63B 22/0235 482/54

* cited by examiner

LEG-POWERED TREADMILL

RELATED APPLICATIONS

This application is a continuation of application Ser. No. 15/186,826, filed Jun. 20, 2016, which '826 application is a continuation of application Ser. No. 14/086,733, filed Nov. 21, 2013, now U.S. Pat. No. 9,468,796, dated Oct. 18, 2016, which '733 application is a continuation of application Ser. No. 13/711,074, filed Dec. 11, 2012, now U.S. Pat. No. 8,690,738 B1 dated Apr. 8, 2014, which '074 application is a continuation of application Ser. No. 12/925,892, filed on Nov. 1, 2010, now U.S. Pat. No. 8,343,016 B1, dated Jan. 1, 2013, which '892 application is a continuation-in-part of a regular examinable utility patent application Ser. No. 12/925,770, filed on Oct. 29, 2010, now U.S. Pat. No. 8,308,619, dated Nov. 13, 2012, the entire disclosures both of which are incorporated by reference herein. Applicant claims priority under 35 U.S.C. § 120 from the aforementioned regular examinable utility patent applications filed under Ser. Nos. 14/086,733, 13/711,074, 12/925,892 and 12/925,770. The entire disclosures of the '826, 733, '074, '892 and '770 applications are incorporated by reference herein. This application and the '826, '733, '074, '892 and '770 applications claim benefit under 35 U.S.C. 119(e) from provisional Application No. 61/280,265 filed Nov. 2, 2009, the entire disclosure of which is incorporated by reference herein.

FIELD OF THE INVENTION

The present invention relates to a motor-less leg-powered treadmill produced that allows people to walk, jog, run, and sprint without making any adjustments to the treadmill other than shifting the user's center of gravity forward and backwards.

BACKGROUND OF THE INVENTION

Exercise treadmills allow people to walk, jog, run, and sprint on a stationary machine with an endless belt moving over a front and rear sets of pulleys.

OBJECTS OF THE INVENTION

It is an object of the present invention to provide a motor-less leg-powered curved treadmill produced that allows people to walk, jog, run, and sprint without making any adjustments to the treadmill other than shifting the user's center of gravity forward and backwards.

It is also an object of the present invention to provide a closed loop curved treadmill belt in a concave shape supported by end rollers in a low friction manner in a substantial stationery frame.

It is also an object of the present invention to provide a curved treadmill that assumes a concave upper contour and a taut lower portion.

Other objects which become apparent from the following description of the present invention.

SUMMARY OF THE INVENTION

The present invention is a motor-less leg-powered curved treadmill produced wherein the curved, low friction surface allows people to walk, jog, run, and sprint without making any adjustments to the treadmill other than shifting the user's center of gravity forward and backwards. This novel speed control due to the curve allows people of any weight and size to adjust their own speed in fractions of a second. The user controls the speed by positioning their body along the curved running surface. Stepping forward initiates movement, as the user propels themselves up the curve the speed increases. To slow down, the user simply drifts back towards the rear curve. For running athletes, no handrails are needed. Handrails are optional for non-athletes with balance or stability limitations. The motor-less leg-powered treadmill permits low foot impact on the running surface through its new design, forcing the user to run correctly on the ball of the feet and therefore reducing pressure and strain of the leg joints. This unique design of the curve in a low friction surface allows any user, regardless of weight and size, to find and maintain the speed they desire. The user steps on the concave curved treadmill belt section and, begins walking, steps up further and begins running, steps up even farther and starts to sprint. When stepping backward the motor-less leg-powered treadmill will stop.

Utilizing a closed loop treadmill belt supported by end rollers in a low friction manner in a substantial stationery frame, the curved treadmill of this invention makes it possible for the user to experience a free running session, with the potential to have the real feeling of running, and the ability to stop and sprint and walk instantly, thereby simulating running outside on a running track. This novel speed control in running was not possible in the prior art because of the lack of curved low friction running surfaces.

The closed loop treadmill belt must be of such a length as compared to the distance between the end rollers to permit it to assume the required concave upper contour. To keep it in that configuration in all operational modes, a method of slackening the curved upper portion while simultaneously keeping the lower portion taut (i.e.—preventing it from drooping down) is used. This method must not add significant friction to the treadmill belt since this would detract from the running experience of the user.

Several methods of controlling the treadmill belt configuration in a low friction manner are described. One method is to use a support belt under the treadmill belt lower portion. This support belt is kept in a taut configuration with a horizontal section by using springs pulling pulleys in opposite directions.

Another method, uses a timing belt linking the treadmill belt end rollers such that after the desired configuration is achieved, the treadmill belt and end rollers must move synchronously thereby denying the treadmill belt the opportunity to have its lower section droop down.

Yet another method is to support the lower section of the treadmill belt from drooping down by directly supporting this section with one or more linear arrays of low friction bearings at the peripheral edges of the belt below the lower section.

In another embodiment of this invention, the treadmill belt is constructed of two loops of v-belt with a custom crossection attached with fasteners near each end of each transverse slat. Thus the adjacent slats cover the entire user surface on the outside of the v-belt loops. The slats themselves can be fabricated from wood, wood products, plastic, or even rubber. The v-belt custom crossection, provides flat extensions on either side of the v-section for support of the treadmill belt away from the large v-belt pulleys at the front and back of the treadmill. By supporting on a resilient continuous belt surface instead of the slats themselves, smoothness of operation is insured.

The v-belt construction provides excellent lateral centering of the treadmill belt in the chassis. Ball bearing support rollers in a linear array at each side bearing on the outer flat v-belt extensions support the bottom portion of the belt to keep it from drooping. A concave array of ball bearings at each side of the chassis supports the treadmill belt by bearing on the inner v-belt extensions to support the top user-contact section. The weight of the treadmill belt itself helps it conform to this support contour.

BRIEF DESCRIPTION OF THE DRAWINGS

The present invention can best be understood in connection with the accompanying drawings. It is noted that the invention is not limited to the precise embodiments shown in drawings, in which.

DETAILED DESCRIPTION OF THE DRAWINGS

The description of the invention which follows, together with the accompanying drawing should not be construed as limiting the invention to the example shown and described, because those skilled in the art to which this invention appertains will be able to devise other forms thereof.

Figure 1:
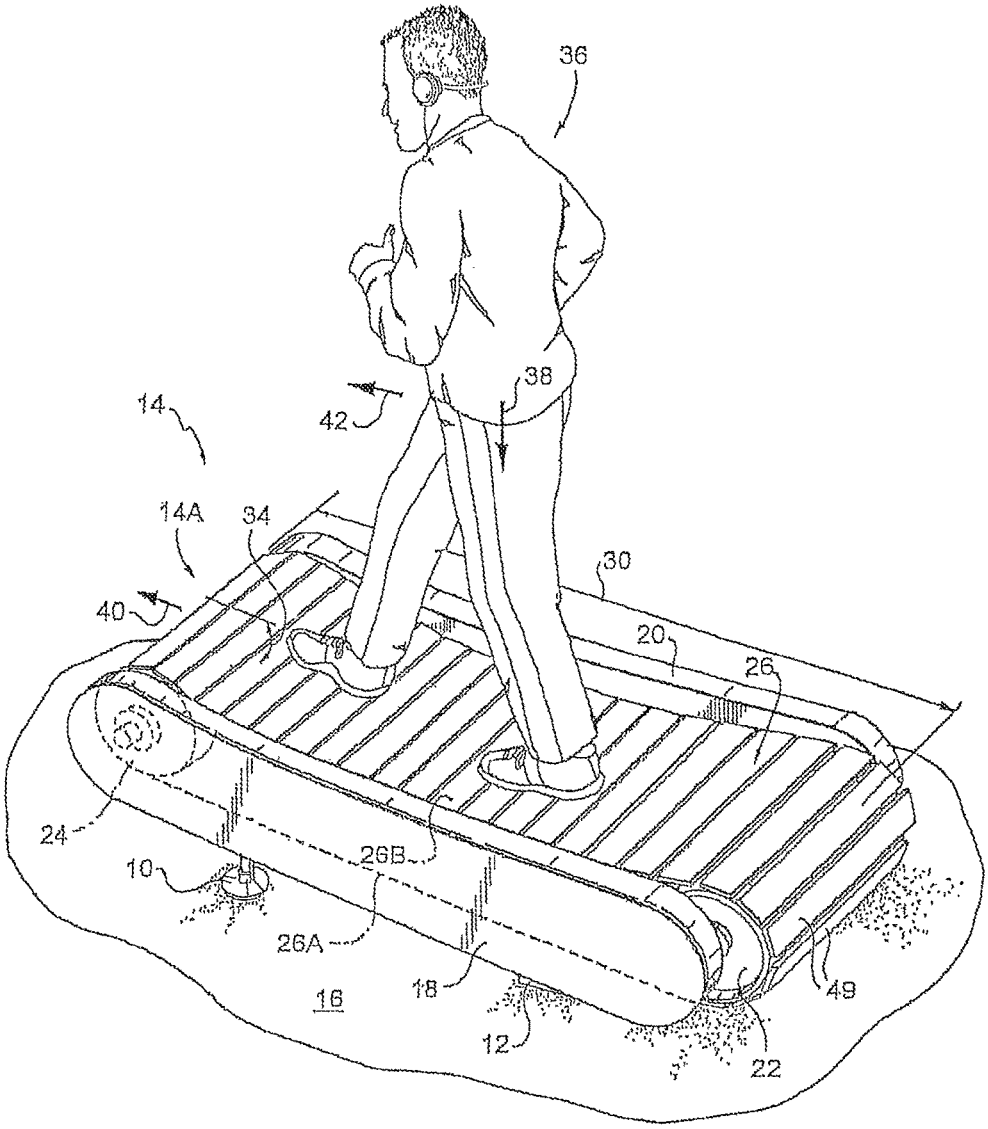
FIG. 1 is a perspective view of the exterior of one embodiment of the present invention; showing the runner in a slow walk in the droop of the concave upper portion of the treadmill ball.

FIG. 1 is a perspective view of a leg-powered treadmill 10 constructed and having an operating mode according to the present invention.

As noted in FIG. 1, no hand rails are shown. The curved treadmill 10 can be used without hand rails. Hand rails can be optionally provided for non-athletes with balance or running stabilities limitations.

Illustrated are two leg supports 10 and 12 which lift the treadmill 14 in a clearance position above a support surface 16, said treadmill 10 having space apart sides 18 and 20 which have journalled for rotation end rollers 22 and 24 which support a closed loop treadmill belt 26. Low friction methods to be described are used to hold taut the length of the lower belt portion 26A in a dimension of approximately forty-three inches denoted by dimension line 30. The upper belt portion 26B weighs approximately forty pounds is also denoted by the dimension line 30.

Figure 1A:
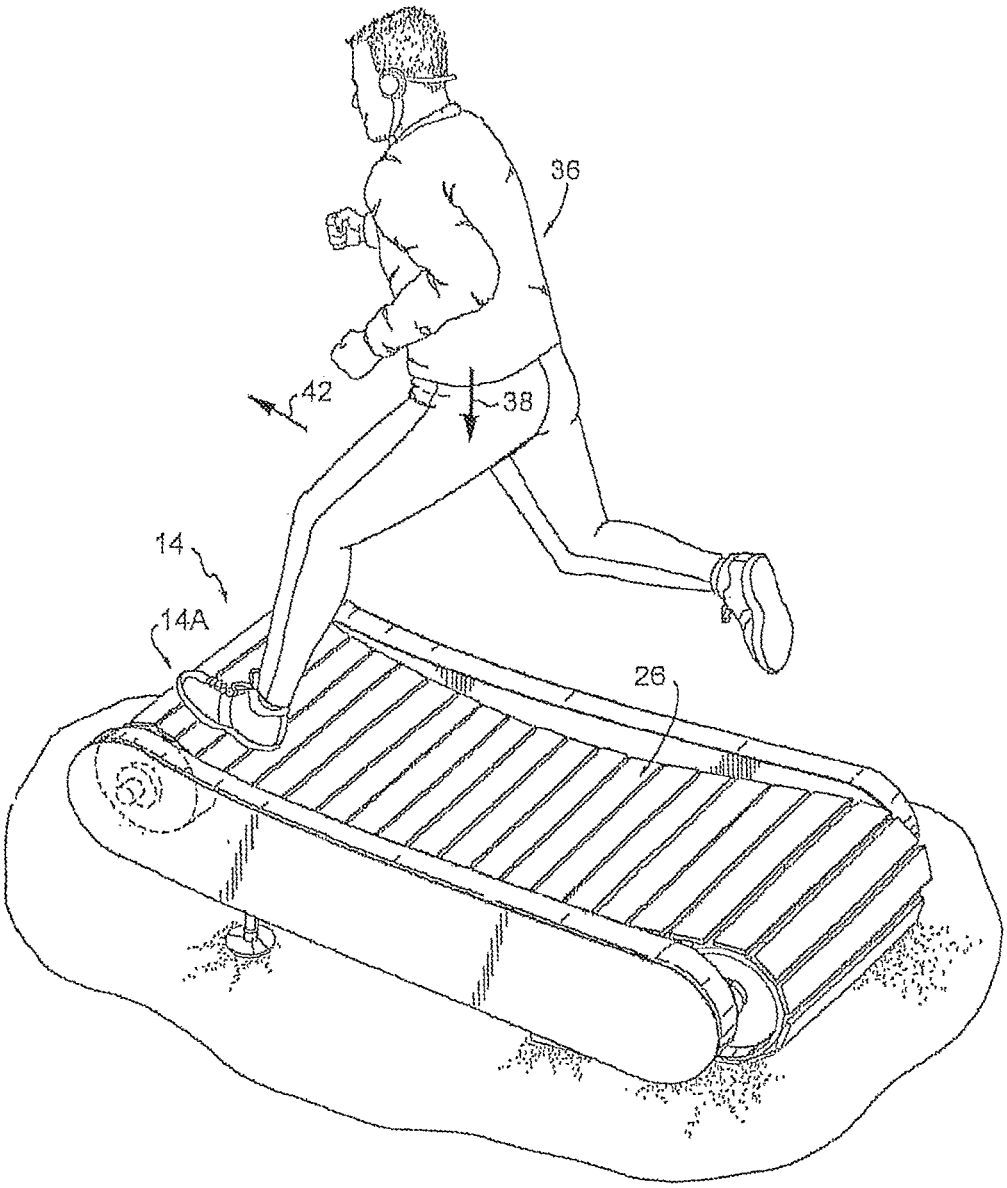
FIG. 1A is a perspective view of the exterior of the embodiment in FIG. 1, showing the runner running at a fast pace uphill.
Figure 1B:
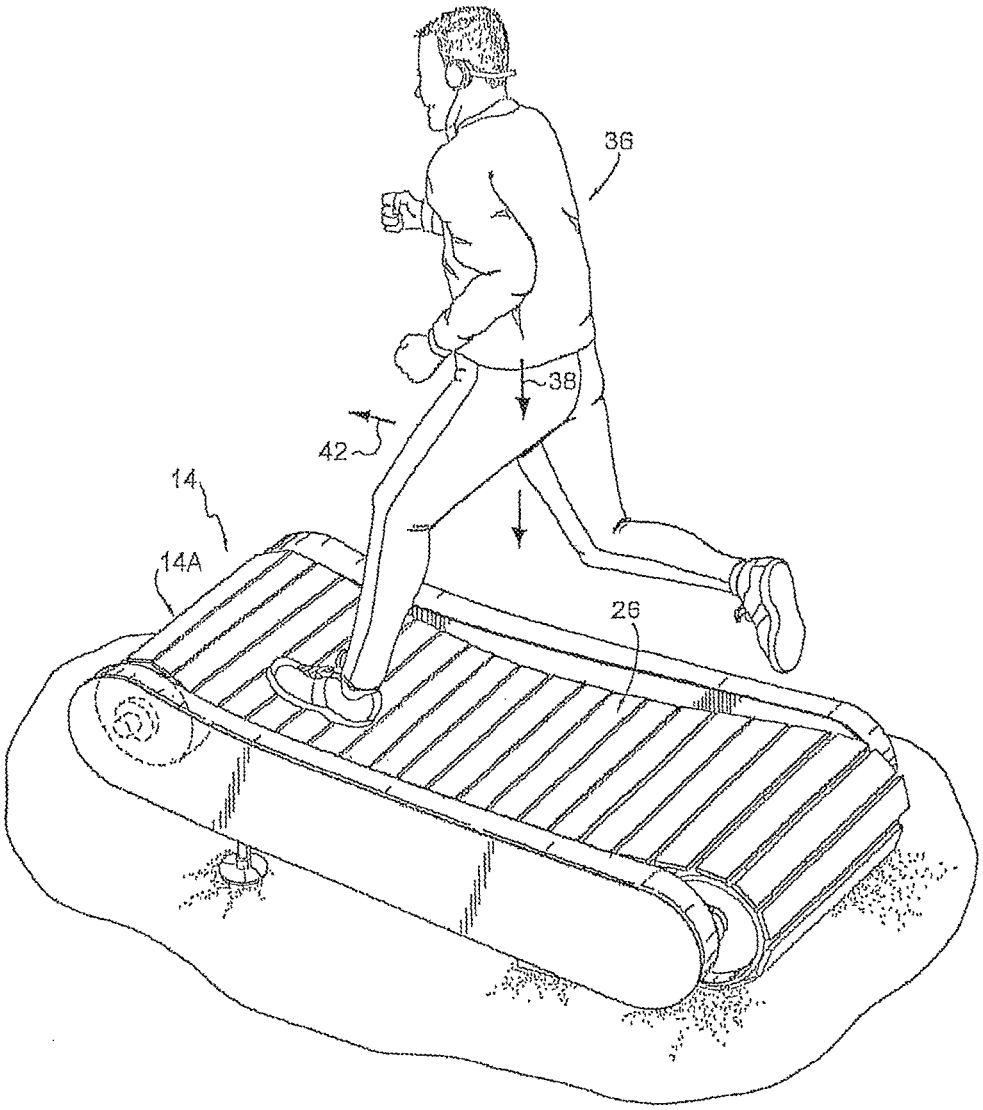
FIG. 1B is a perspective view of the exterior of the embodiment in FIG. 1, showing the runner running slowly in the droop of the concave portion.

It is to be noted that an essential feature of treadmill 10 is a concave shape subtending an acute angle 34 in the treadmill 10 front end 14A which in practice results in the exerciser 36 running uphill and concomitantly exerting body weight 38 that contributes to driving lengthwise 40 in the direction 42 in which the exerciser runs and achieves the benefits of the exercise. As the runner 36 encounters the different positions on the treadmill belt 26 of the treadmill 14, the angle of the surface of running changes For example, as shown in FIG. 1, when the center of gravity of body weight, indicated by downward directional arrow 38, below the hips of the user 36, is in the lower dropping portion of the concave upper portion 26B of the treadmill belt 26, the runner 36 walks or slowly jogs in a generally horizontal orientation, as indicated by directional arrow 42 in a first slow jogging speed. But, as shown in FIG. 1A, as the runner 36 speeds up and advances the runner's hips and center of gravity of body weight further for up the angled slope at the front end 14A of the treadmill belt 26, the angle of movement 42 changes from a generally horizontal angle 42 in FIG. 1 to an acute angle 42 up off the horizontal as in FIG. 1A, which concurrently causes the runner 36 to run vigorously faster, at the acute angle 42 up the slope of the front 14A of the concave curve of upper belt portion 26B of treadmill belt 26, the runner 36 runs faster uphill. Furthermore, as shown in FIG. 1B, it does not matter where the runner 36 puts the forward foot to change the speed. In FIG. 1B the center of gravity in the hip region of the runner 36's body weight, indicated by downward directional arrow 38, is still in the lower part of the concave droop of the upper portion 26A of treadmill belt 26. So even though the runner 36 in FIG. 1B is jogging faster than walking or slowly jogging as in FIG. 1, so long as the runner 36 has the forward foot partially up the angled slope of the forward portion 14A of the upper belt portion 26B, the runner will still run slower in FIG. 1B, not because the forward foot is up the slope of upper belt portion 26B of the treadmill belt 26, but because the center of gravity of body weight, as indicated by downward directional arrow 38, is still within the lower confines of the droop of the concave upper belt portion 26B. Therefore, what changes the speed of the runner 36 and the treadmill belt 26, is when the runner 36 moves the center of gravity of the hips of the body weight indicated by downward directional arrow 38 higher up the slope of concave upper portion 26B of treadmill belt 26, which causes the runner to run faster and the belt 26 to concurrently move faster around pulleys 22 and 24 with the pace of the forward advancing runner 36.

It is known from common experience that in prior art treadmills, the upper length portion of their closed loops are flat due, it is believed, because of the inability to maintain the concave shape 34 in the length portion 26B. This shortcoming is overcome by the weight 30 which in practice has been found to hold the concave shape 34 during the uphill running of the exerciser 36.

A closed loop treadmill belt 26 is formed with a running surface of transverse wooden, plastic or rubber slats 49 (see FIG. 1) attached to each other in a resilient fashion. Since an essential feature of treadmill 10 is the concave shape of the low friction running surface of belt 26 in upper portion 26B, methods are used to insure that this shape is maintained during actual use. These methods must prevent the lower portion 26A of treadmill belt 26 from drooping down (i.e., must be held taut), otherwise top portion 26B would be pulled taut into a flat shape between rollers 22 and 24. Three methods are illustrated by the side view schematic drawings of FIGS. 2-4.

Figure 2:
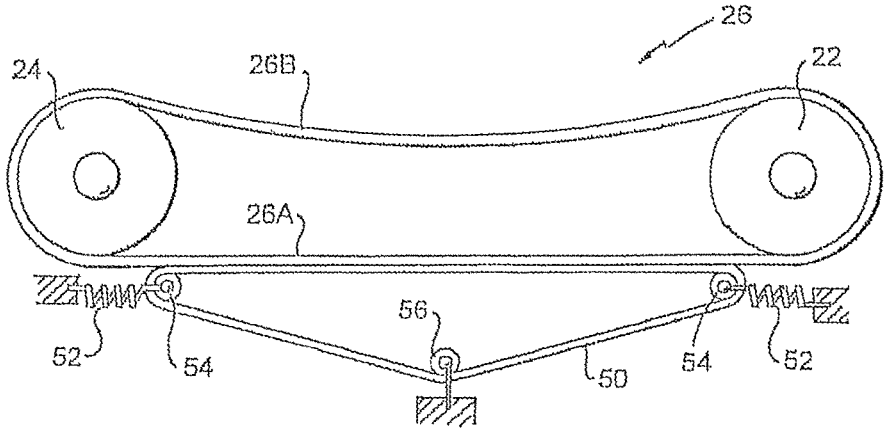
FIG. 2 is a diagrammatic side view of the system components for the embodiment of FIG. 1 for implementing the present invention.

The method of FIG. 2 shows a flat support belt loop 50 engaged with two side pulleys 54 and a third pulley 56 which is attached to treadmill 10 frame. Two springs 52 pulling in opposite directions hold belt 50 taut with a flat top configuration in contact with bottom treadmill belt portion 26A. Since pulleys 54 and 52 are low friction, and there is no relative movement between belt 50 and belt 26, belt 50 imposes very little drag on belt 26 while supporting lower belt portion 26A vertically preventing it from drooping down.

Figure 3:
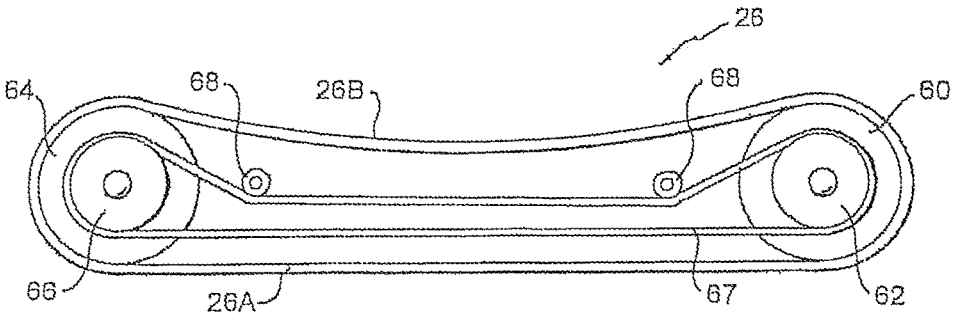
FIG. 3 is a diagrammatic side view of the system components for a second embodiment for implementing the present invention.

The method shown in FIG. 3 shows the use of a timing belt 67 in achieving a similar result. Here end rollers 60 and 64 are attached to timing belt pulleys 62 and 66 respectively. Timing belt idlers 68 are simply used to configure timing belt geometrically to fit within the constraints of the side contours of treadmill 10. If belt 26 is prevented from slipping relative to end rollers 60 and 64 by high friction coefficient (or by the use an integral timing belt on the inside of belt 26 and rollers with timing belt engagement grooves), once configured as shown, timing belt 67 will not permit drooping down of section 26A since all motion is now synchronous.

Figure 4:
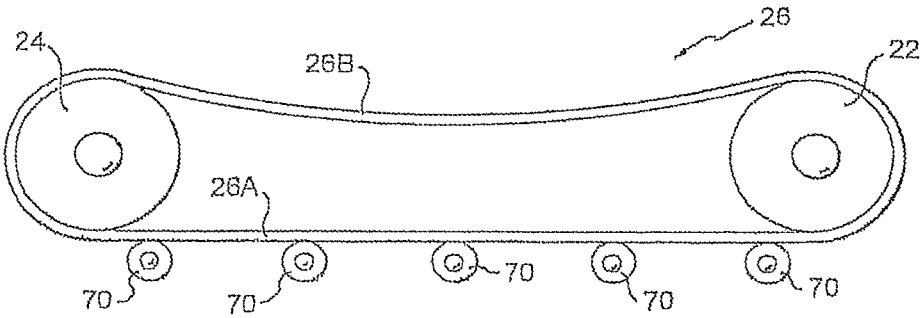
FIG. 4 is a diagrammatic side view of the system components for a third embodiment for implementing the present invention.

In another method shown in FIG. 4, one or more linear arrays of bearings 70 extending along opposite peripheral edges of said treadmill frame physically support lower section 26A of treadmill belt 26 thereby preventing drooping. Bearings 70 may be ball bearings or straight ball bearing casters attached and located at respective side peripheral edges to the bottom surface of the frame of treadmill 10.

Figure 5:
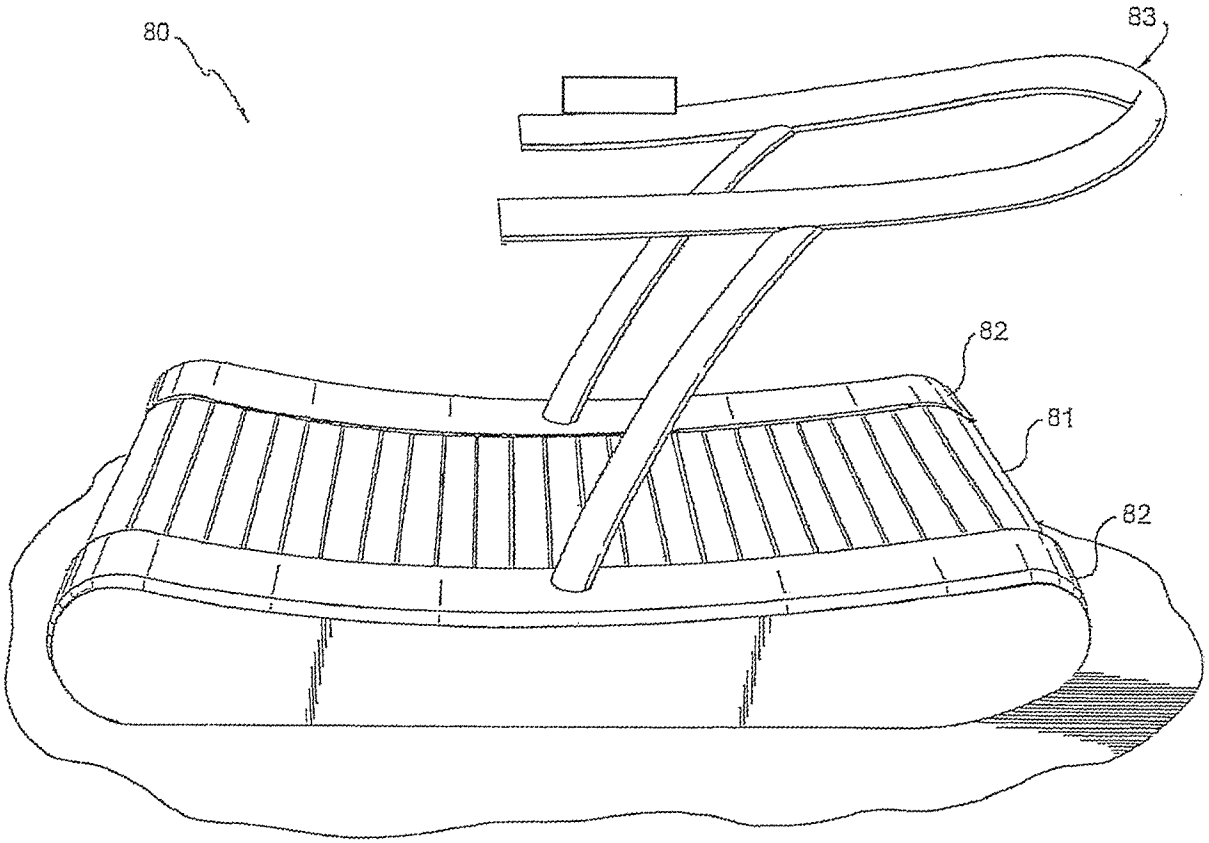
FIG. 5 is a perspective view of the third embodiment shown in FIG. 4, having a v-belt and a lower linear array of ball bearings in the curved treadmill, and showing an optional removable handlebar assembly.

In the v-belt treadmill embodiment 80 of FIG. 5, side covers 82 enclose the underlying chassis. Running surface 81 comprises a concave surface of transverse slats. Optional handle bar assembly 83 helps users who are balance-challenged to use treadmill 80; it is both optional and removable.

Figure 6:
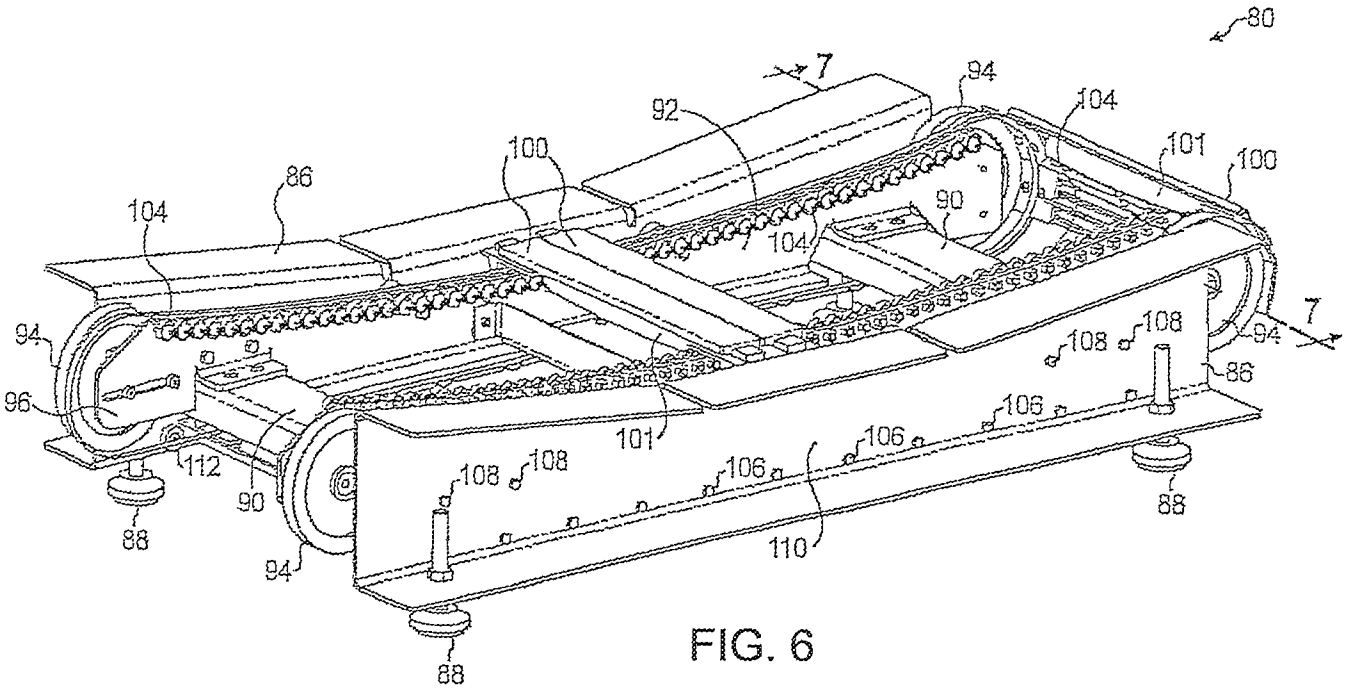
FIG. 6 is a perspective view of the curved treadmill embodiment of FIG. 5 having a v-belt and a lower linear array of ball bearings, with the side covers and treadmill belt removed to reveal the various operating parts.

FIG. 6 shows the chassis of the treadmill of FIG. 5. Robust cross beams 90 attach both outer frames 86 as well as inner frames 92 on each side to each other creating the roughly rectangular chassis. Bolts 108 attach the outer frames 86 to cross beams 90. A few slats 100 are shown; they each have one or more downwardly extending reinforcing fins 101 attached on the inner side. Regardless of the material selected for the slats, they must exhibit, the desired resiliency and strength along with sufficient weight to lie on and conform to the concave row of upper support ball bearings 104 at each side. The peripheral bearings are spaced apart from each other on respective left and right sides of the curved treadmill 80, wherein the fins 101 of the transverse slats 100 extend cantilevered downward from each transverse slat 100 so that the transverse slats 100 are resilient to dip slightly under the weight of the user runner without any lower support directly below the transverse slats 100. FIGS. 7A and 7B show a treadmill slat 100 with multiple fins 101, as shown in FIG. 6.

Figure 7:
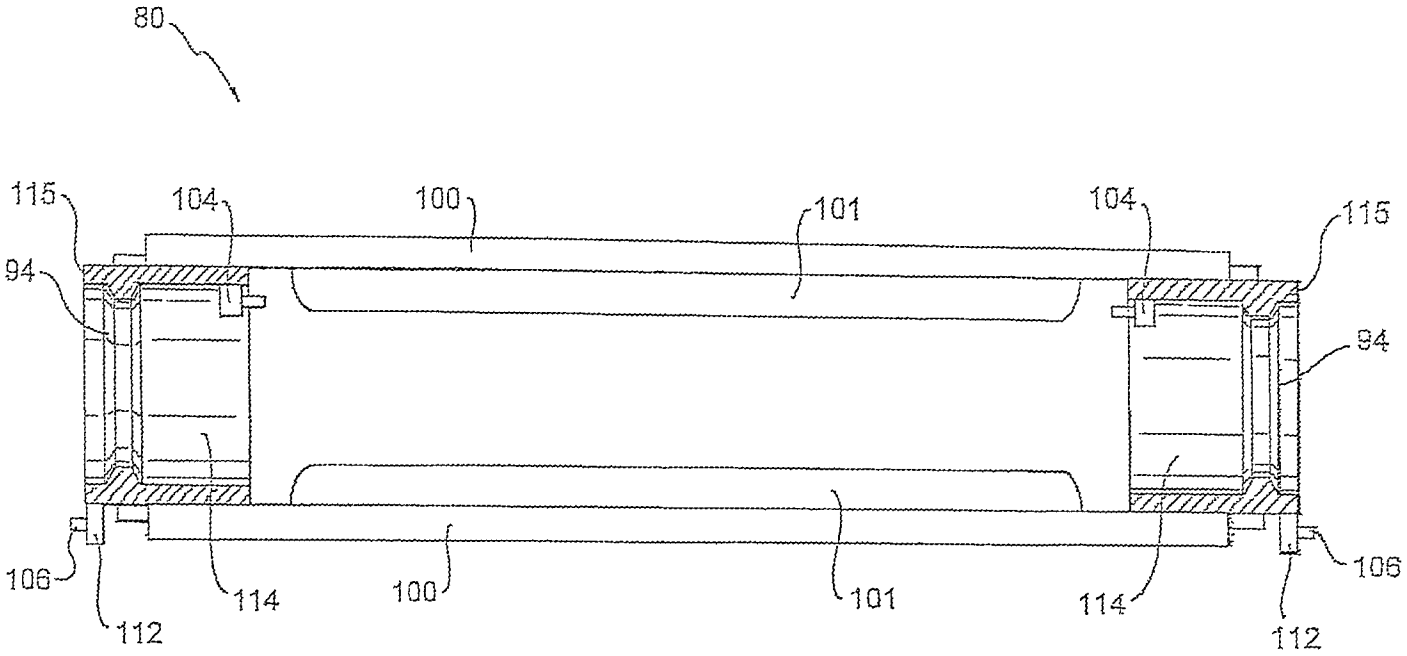
FIG. 7 is an end view of the curved treadmill embodiment of FIG. 5 having a v-belt and a lower linear array of ball bearings, illustrating the support of a top slat and a bottom slat using the side extension features of the custom v-belt.
Figure 7A:
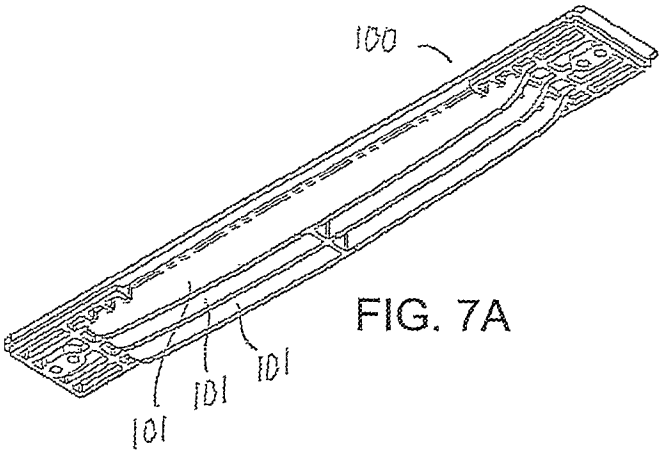
FIG. 7A is a perspective view viewed from below of a treadmill slat with multiple fins as shown in FIG. 6.
Figure 7B:
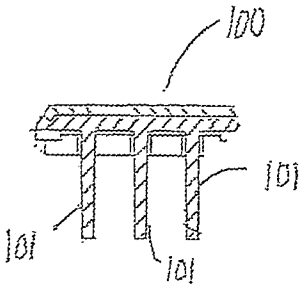
FIG. 7B is an end crossectional view of the multi-finned treadmill slat as in FIG. 7A.
Figures 7C, 7D, 7E:
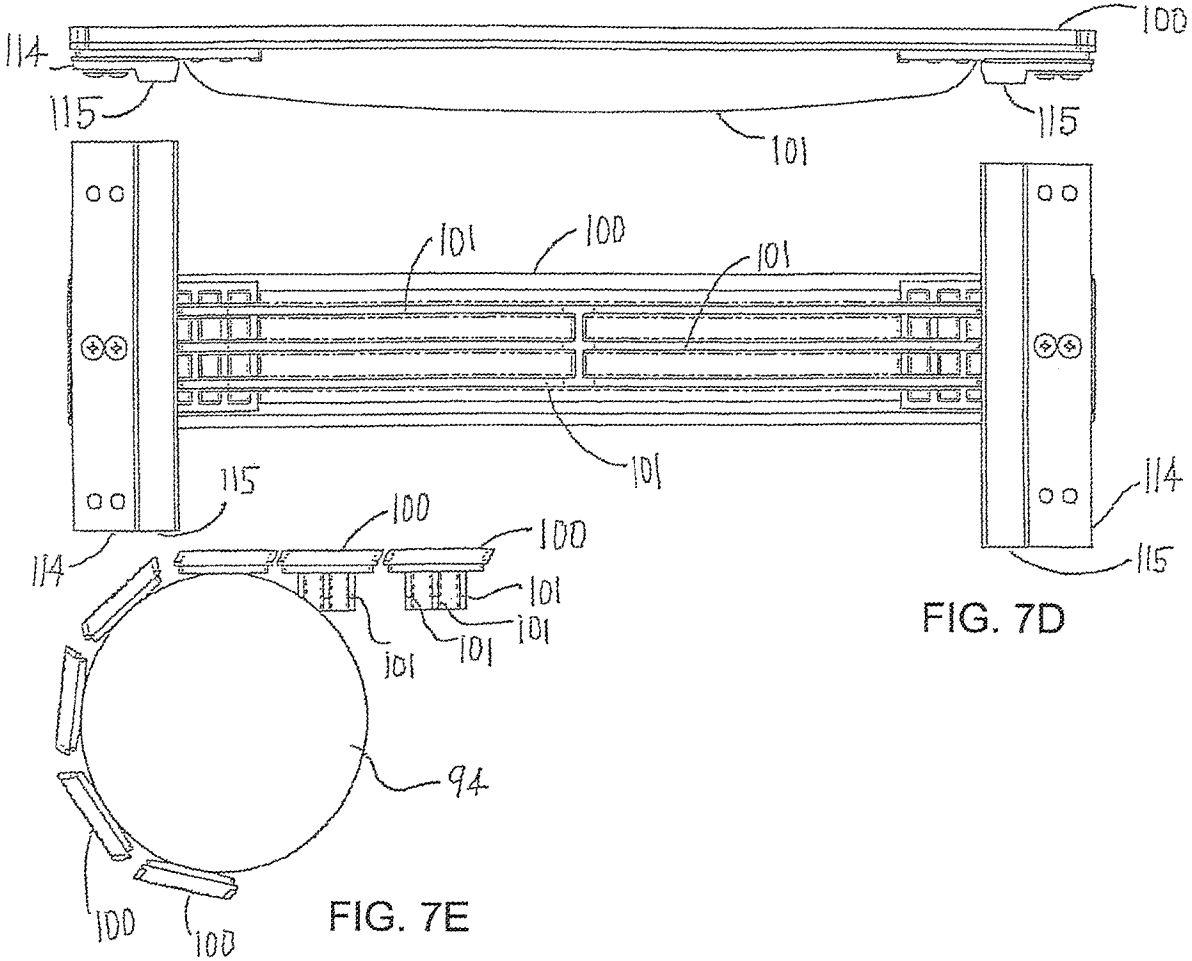
FIG. 7C is a front view of the treadmill slat as in FIGS. 7, 7A and 7B, shown with attached v-belts.
FIG. 7D is a bottom view of the treadmill slat as in FIGS. 7, 7A and 7B, shown with attached v-belts.
FIG. 7E is a diagrammatic side view showing treadmill slats with fins engaging around pulley.
Figure 8:
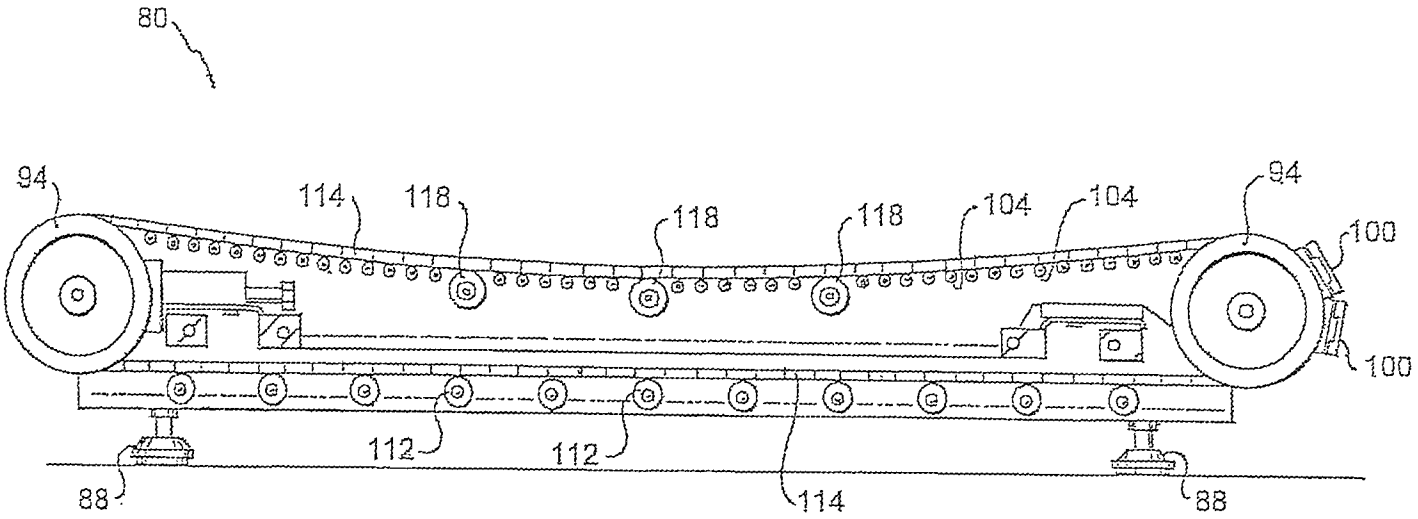
FIG. 8 is a side elevation of the v-belt treadmill chassis of the embodiment of FIG. 5 with a v-belt and a lower linear array of ball bearings, showing the supported path of the v-belt; wherein the vertical side of the outer frame member is rendered invisible for clarity of detail.

FIGS. 7C and 7D show the slats 100 with descending fins 101 and with v-belts 114, each having crossectional v-belt extensions 115, which engage pulley 94, as shown in FIGS. 7 and 7E, where slats 100 with fins 101 engage around pulleys 94. FIG. 7 shows slat 100 with at least one fin 101, where slat 100 is attached to belt 114 having crossectional extensions 115, and where belt 114 goes around pulleys 94, as shown in FIG. 8, which also shows slats 100, belt 114 and pulleys 94.

Figure 7F:
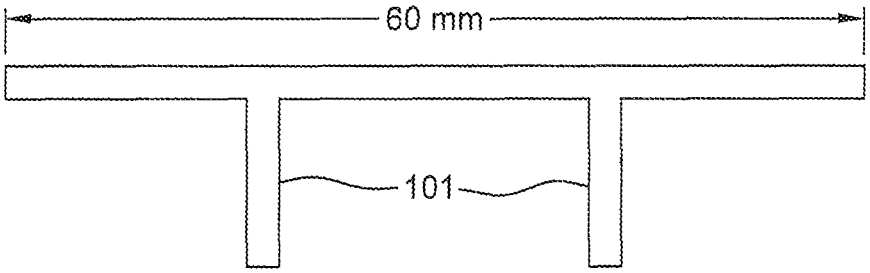
FIG. 7F is an end crossectional view of a multi-finned treadmill slat with a pair of descending fins.
Figure 7G:
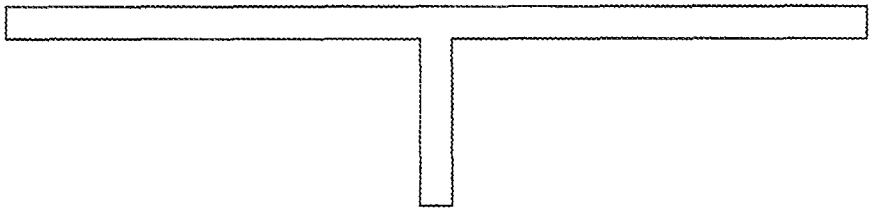
FIG. 7G is an end crossectional view of a finned treadmill slat with one single descending fin.
Figure 7H:
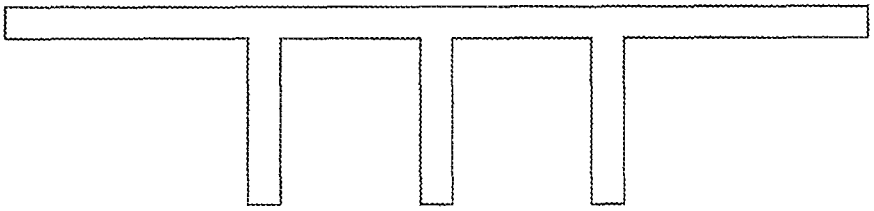
FIG. 7H is an end crossectional view of a multi-finned treadmill slat with a three descending fins.

FIG. 7F shows a finned treadmill slat with a pair of descending fins. FIG. 7G shows a finned treadmill slat with one single descending fin. FIG. 7H shows the multi-finned treadmill slat with three descending fins.

Figure 7J:
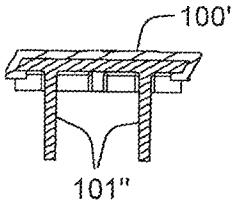
FIG. 7J is an end crossectional view of the slat with a pair of fins as in FIG. 7I.
Figure 7L:
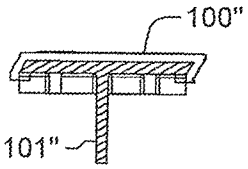
FIG. 7L is an end crossectional view of the slat with one fin as in FIG. 7K.
Figure 7I:
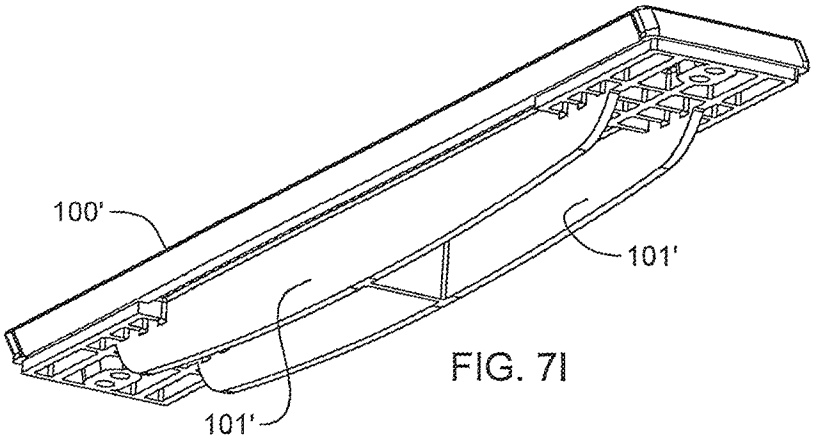
FIG. 7I is a perspective view viewed from below a treadmill slat with a pair of fins.

FIG. 7I depicts from below a treadmill slat 100' with a pair of descending fins 101', 101'.

FIG. 7J shows the slat 100' with a pair of fins 101', 101', as in FIG. 7I.

Figure 7K:
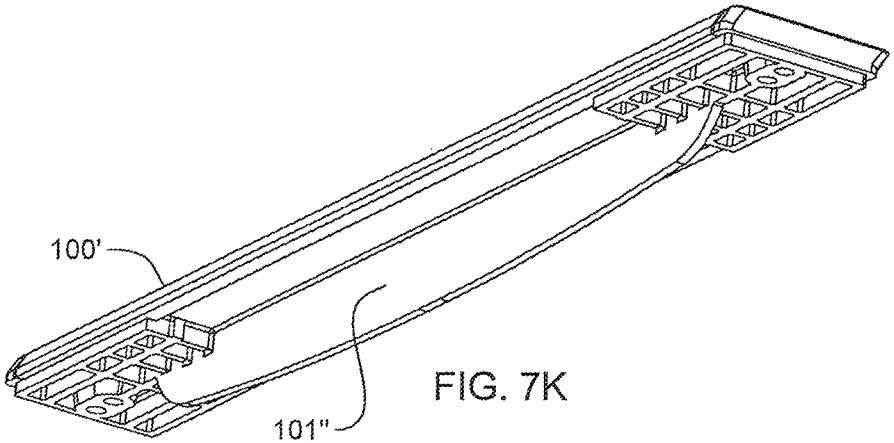
FIG. 7K is a perspective view viewed from below of a treadmill slat with one fin.

FIG. 7K depicts from below a treadmill slat 100' with one single fin.101"

FIG. 7L shows the slat 100" with one fin 101" as in FIG. 7K.

Transverse slats 100, 100' and 100" may be made of rubber, wood or synthetic plastic materials.

FIGS. 7I and 7J show treadmill slats 100' with a pair of descending fins 101'.

FIGS. 7K and 7L show treadmill slats 100" with a single descending fin 101".

The construction of the treadmill belt and its path around the chassis contour will be illustrated in FIGS. 7 and 8. The v-belt (not shown in this FIG. 6) rides in v-belt pulleys 94 at front and back. Since the treadmill belt formed from two v-belt loops with transverse slats 100 attached is itself a large heavy loop, adjusters 96 on the rear (and/or front) pulleys 94 are used during initial installation and to fine tune the distance between the front and back pulleys 94 for precise smooth operation that is not so tight as to bind, nor too loose as to be noisy. Bolts 106 (on both sides) attach a linear array of ball bearings 112 to support the bottom of treadmill belt 81 to prevent drooping. Level adjusters 88 are used to adjust the tilt of treadmill 80.

FIG. 7 shows the two v-belts 114 in an inner end view near front end pulleys 94. The two v-belt crossections 115 are plainly illustrated showing the short outer extension and the longer inner extension on each side of the "v". Top slat 100 with fin 101 facing downward is shown at the top. In this view, at each crossection 115, two bolt heads are clearly shown; they fasten the longer inner flat belt extension to the end of slat 100. At each side the belt "v" is clearly positioned within the top groove of pulley 94 with ball bearing 104 supporting the edge of treadmill belt 81 through the resilient smooth continuous inner extension of belt 114. Similarly, at the bottom slat 100 fin 101 is now positioned facing up into the vacant midsection. Larger ball bearings 112 supporting the bottom belt 81 section are seen impinging on short outer v-belt 114 extensions at each side.

FIG. 8 is a side view of the chassis with outer vertical side 110 of outer frame 86 rendered invisible to reveal the relative position of the other components in the v-belt support pathway. Only two slats 100 are shown attached to v-belt 114 (on the right pulley 94) for clarity. Note the taut, non-sagging position of the bottom section of belt 114 as supported by array of ball bearings 112. On top, the drooping concave belt 114 is supported by the concave array of ball bearings 104. The three centrally located v-belt idler pulleys 118 keep belt 114 from moving laterally far from large end v-belt pulleys 94. The weight of treadmill belt 81 keeps it in contact with the concave contour of ball bearings 104 at any speed from stopped to full running.

In the foregoing description, certain terms and visual depictions are used to illustrate the preferred embodiment. However, no unnecessary limitations are to be construed by the terms used or illustrations depicted, beyond what is shown in the prior art, since the terms and illustrations are exemplary only, and are not meant to limit the scope of the present invention.

It is further known that other modifications may be made to the present invention, without departing the scope of the invention, as noted in the appended claims.

What is claimed is:

1. A motor-less, leg-powered treadmill, with a curved running surface, comprising:

a treadmill frame;

a front shaft and a rear shaft that are each positioned respectively in a front and rear of the treadmill frame and configured for synchronous rotation;

pairs of front and rear pulley rollers attached on opposing ends of the front and rear shafts, respectively;

opposing arrays of bearings, arranged as bearing rails and positioned between the front and rear shafts on opposing peripheral sides of the treadmill frame; and a closed loop treadmill belt arranged to rotate about the pulley rollers synchronously with rotation of the front and rear shafts, while maintaining contact with the bearing rails;

wherein the closed loop treadmill belt comprises a plurality of parallel transverse slats that are resiliently interconnected to form the curved running surface; and wherein the bearing rails follow a catenary curve that is inherently defined by a weight of a portion of the closed loop treadmill belt that extends between a 0-degree position of the front and rear pulleys, and a distance between respective central axes of the front and rear shafts.

2. The motor-less, leg-powered treadmill as per claim 1, wherein each slat of the plurality of parallel transverse slats includes an upper surface, a bottom surface and at least one fin, extending down from the bottom surface.

3. The motor-less, leg-powered treadmill as per claim 2, wherein the at least one fin extends continuously over substantially an entire length of each of the transverse slats between the opposing peripheral sides of the treadmill frame.

4. The motor-less, leg-powered treadmill as per claim 1, wherein each of the plurality of parallel transverse slats is made of a material with sufficient resiliency and strength and weight to lie on bearing rails and conform to the catenary curve of the bearing rails.

5. The motor-less, leg-powered treadmill as per claim 1, wherein each of the plurality of parallel transverse slats comprises a material selected from the group consisting of rubber, plastic and wood.

6. An exercise treadmill comprising:

a treadmill frame;

said treadmill frame supporting a continuous treadmill running surface belt moving over a set of pulleys communicating with said treadmill running surface belt;

said continuous treadmill running surface belt being a closed loop array of a plurality of transverse parallel slats, wherein each said transverse parallel slat includes at least one fin descending downward from each said transverse slat, said at least one fin of each said slat extending perpendicular down from each said slat.

7. The exercise treadmill as per claim 6, wherein the at least one fin extends continuously over substantially an entire length of each of the transverse slats between the opposing peripheral sides of the treadmill frame.

8. A motor-less, leg-powered curved treadmill comprising:

a treadmill frame having opposing upper portions at peripheral sides of the treadmill frame;

a concave row of upper support peripheral ball bearings located at each of the peripheral left and right sides of the treadmill frame; and a set of respective front and rear pulley end rollers for rotation;

a closed loop treadmill belt, wherein said front and rear pulley end rollers support said closed loop treadmill belt;

wherein said closed loop treadmill belt comprises a plurality of parallel transverse slats, each said parallel transverse slat oriented parallel to an axis of rotation of said belt and attached to each other in a resilient fashion; and wherein each said transverse slat includes at least one fin descending downward from each said transverse slat and formed with a material with sufficient resiliency, strength and weight to lie on and conform to the respective concave rows of the upper support peripheral ball bearings.

9. The motor-less, leg-powered curved treadmill as in claim 8, wherein each said rows of peripheral ball bearings are spaced apart from each other on the respective left and right sides of said treadmill frame, wherein said fins of said transverse slats extend cantilevered downward into a vacant mid-section of said treadmill from each said transverse slat and wherein said resiliency enables said transverse slats to dip slightly under the weight of the user runner without any lower support below non-peripheral mid-sections of said transverse slats.

10. The motor-less, leg-powered treadmill as per claim 8, wherein each of the plurality of parallel transverse slats comprises a material selected from the group consisting of rubber, plastic and wood.

* * * * *